United States Patent [19]

Miles et al.

[11] Patent Number: 4,770,320

[45] Date of Patent: Sep. 13, 1988

[54] SHEET AND DISPENSER PACKAGE THEREFOR

[75] Inventors: Alden R. Miles, Burnsville; Theodore F. Schwandt, St. Paul; James C. Nygard, Maplewood, all of Minn.; Harry A. Loder, Dripping Spring, Tex.; John J. Emmel, Blaine, Minn.

[73] Assignee: Minnesota Mining and Manufacturing Company, St. Paul, Minn.

[21] Appl. No.: 57,625

[22] Filed: Jun. 3, 1987

[51] Int. Cl.[4] ..... B65H 1/00; A47K 10/24; A45C 11/18

[52] U.S. Cl. ..... 221/33; 221/46; 206/39.3; 206/39.7; 206/494

[58] Field of Search ..... 221/33, 45, 46; 206/39.7, 39.3, 494; 402/79; 283/81; 281/1; 428/192, 194

[56] References Cited

U.S. PATENT DOCUMENTS

| | | | |
|---|---|---|---|
| 2,514,612 | 7/1950 | Snow | 221/46 X |
| 3,950,580 | 4/1976 | Boudet | 428/41 |
| 4,191,306 | 3/1980 | Rabner | 206/39.7 X |
| 4,416,392 | 11/1983 | Smith | 221/45 |
| 4,562,938 | 1/1986 | Loder | 221/46 |
| 4,586,629 | 5/1986 | Loder | 221/46 |
| 4,650,706 | 3/1987 | Emmel | 428/194 X |
| 4,653,666 | 3/1987 | Mertens | 221/45 |
| 4,674,634 | 6/1987 | Wilson | 206/494 X |

*Primary Examiner*—H. Grant Skaggs
*Assistant Examiner*—Gregory L. Huson
*Attorney, Agent, or Firm*—Donald M. Sell; William L. Huebsch

[57] ABSTRACT

A sheet including a layer of flexible polymeric material having a coating of repositionable pressure sensitive adhesive on a second end portion that is generally transparent when adhered to a substrate, while being free of adhesive along a visually distinctive first end portion. A pad of the sheets in a stack with adjacent ends of the sheets aligned and with the first and second ends of successive sheets adjacent can be disposed in a chamber partially defined by a top wall having a slot through which the first end portion of the uppermost sheet projects. Relative movement is afforded between the top wall and the uppermost sheet to afford, as the uppermost sheet is pulled through the slot, alignment of the slot with successive portions of the uppermost sheet toward its second end as those successive portions are peeled from the stack. In a final relative position between the top wall and the uppermost sheet the slot is along the second end portion of that sheet and the first end portion of the underlying sheet to cause movement of the first end portion of the underlying sheet through the slot with the second end portion of the uppertmost sheet to leave the first end portion of the underlying sheet projecting through the slot after the uppermost sheet is removed.

12 Claims, 4 Drawing Sheets

SHEET AND DISPENSER PACKAGE THEREFOR

TECHNICAL FIELD

The present invention relates to sheets adapted to mark portions of substrates such as written documents, and dispenser packages for such sheets.

BACKGROUND ART

The art is replete with structures for sheets adapted to mark portions of substrates such as written documents, and dispenser packages for such sheets. Sheets from Post-it brand note pads available from Minnesota Mining and Manufacturing Company are used extensively as such sheets, and are particularly useful for that purpose because a repositionable pressure sensitive adhesive with which they are coated allows them to be placed on and removed from a document without damage to the document. Such sheets are not as suitable for marking portions of substrates as may be desired, however, because relatively small percentages of such sheets are coated with the repositionable pressure sensitive adhesive so that they are sometimes dislodged during handling; because the sheets are made of paper and easily become damaged, and because the sheets are opaque so that they obscure more of the document they are marking than may be desired.

DISCLOSURE OF THE INVENTION

The present invention provides a sheet that can be adhered to and removed from substrates such as written documents without damage to the substrate, can have a large portion coated with repositionable adhesive to provide secure engagement with the substrate until it is intentionally removed, withstand normal handling without damage, and does not obscure a significant part of the substrate to which it is attached.

According to the present invention there is provided a sheet of flexible polymeric material having a coating of repositionable pressure sensitive adhesive on a second end portion of one side surface while being free of adhesive on both of its side surfaces along a first tab end portion which is preferably smaller than its second end portion and is visually distinctive (e.g., brightly colored), with its adhesive coated second end portion being generally transparent when adhered to a substrate. Such sheets can be releasably adhered to a substrate such as a written document to, for example, identify portions to be noted or written on and can be removed without damaging the substrate; will adhere well even during handling of the substrate because of the relatively large percentage of its surface that is adhesive coated; will be easy to spot because of its visually distinctive tab end portion; will not substantially obscure portions of the substrate to which it is adhered because of the transparency of its second portion; and preferably can be written on.

Preferably the sheet comprises only a single polymeric layer, and the tab end portion is printed with a brightly colored ink to provide the visual distinction so that a plurality of the sheets can be adhered together in a pad having an essentially uniform thickness.

Also preferably a plurality of the sheets are included in a dispenser package with the sheets being releasably adhered to each other by the coatings of pressure sensitive adhesive to form a stack with adjacent ends of the sheets aligned and with the tab and second ends of successive sheets in the stack being adjacent. The dispenser also includes an enclosure comprising walls defining a chamber in which the stack of sheets is positioned, which walls include a top wall defining a generally central transverse slot positioned adjacent an uppermost sheet in the stack with the first end portion of the uppermost sheet projecting through the slot. Means are provided for affording relative movement between the portion of the top wall defining the slot and the uppermost sheet in the stack (i.e., by making the stack movable in the enclosure, or at least a portion of the uppermost wall of the enclosure movable relative to the rest of the housing and the stack) from initial to final relative positions to afford, as the uppermost sheet is pulled through the slot, alignment of the slot with successive portions of the uppermost sheet toward the second end of the uppermost sheet as the successive portions are peeled from an underlying sheet in the stack. In the final position the slot is positioned transverse of the second end portion of the uppermost sheet and the first end portion of the underlying sheet to afford folding and movement through the slot of the underlying sheet with the second end portion of the uppermost sheet to leave, after the uppermost sheet is fully peeled from the underlying sheet, the first end portion of the underlying sheet in a position projecting through the slot and the underlying sheet and portion of the top wall defining the slot in their initial relative position. Thus, as each sheet is manually pulled from the stack through the slot, the first end portion of the sheet below it in the stack will also be pulled through the slot and left in a position at which it also may be pulled from the stack; and the sheets can thus be sequentially pulled from the stack until the stack is depleted.

The dispenser package is not only useful with stacks of sheets of the type described above, but also with stacks of any flexible sheets, each of which sheets has opposite top and bottom major side surfaces and first and second opposite ends, and has a coating of pressure sensitive adhesive on at least a second major end portion of its bottom side surface adjacent its second end; which sheets are releasably adhered to each other by adhesion of their coatings of pressure sensitive adhesive to portions of the top surfaces of underlying sheets adjacent the first ends of the underlying sheets to form the stack with adjacent ends of the sheets aligned and with the first and second ends of successive sheets in the stack being adjacent, and having means for preventing adhesion of minor first end portions of the sheets adjacent their first ends to underlying sheets in the stack. In addition to non adhesive coated minor first end portions as described above, such means for preventing adhesion of minor first end portions of the sheets adjacent their first ends to underlying sheets in the stack can be provided by coatings of release materials on-parts-of--.the. top surfaces of the sheets adjacent their second ends. Such sheets can be coated with pressure sensitive adhesive over their entire bottom surfaces, which may be useful for sheets used for certain purposes, and may or may not have visually distinctive portions.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
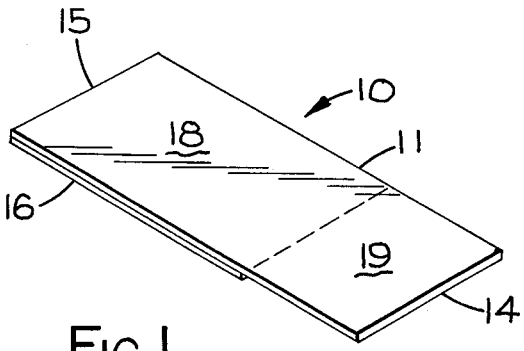
FIG. 1 is a perspective view of a first embodiment of a sheet according to the present invention.

Referring now to FIG. 1 of the drawing, there is shown a first embodiment of a sheet for the marking of portions of documents according to the present invention generally designated by the reference numeral 10. The sheet 10 comprises only a single elongate rectangular layer 11 of transparent flexible polymeric material (e.g., preferably 0.0056 centimeter or 0.0022 inch thick cellulose acetate although such material from 0.0038 to 0.0076 centimeter thick is also usable) having opposite major side surfaces and first and second opposite ends 14 and 15, and having a coating 16 of repositionable pressure sensitive adhesive (e.g., the pressure sensitive adhesive described in U.S. Pat. Nos. 3,691,140 and 4,166,152 incorporated herein by reference) on a second end portion 18 of one of the side surfaces adjacent the second end 15 while being free of adhesive on both of the side surfaces along a first tab end portion 19 thereof adjacent the first end 14. The tab end portion 19 is smaller in area than the second end portion 18 (e.g., about one half its area as illustrated), and is printed with a bright colored ink (e.g., red, green or yellow) to make it visually distinctive; while the adhesive coated second end portion 18 is generally transparent when adhered to a substrate so that it will not obscure a substrate to which it is attached. Also, preferably the side surface opposite the coating 16 of adhesive is adapted to be written on by methods known in the art.

Figure 2:
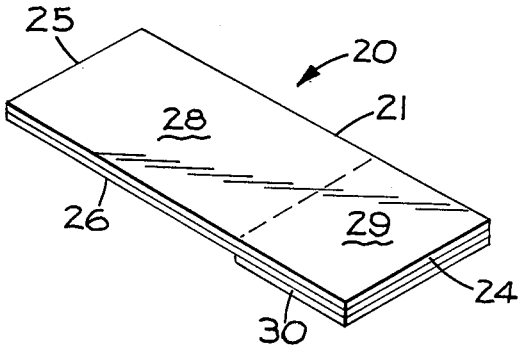
FIG. 2 is a perspective view of a second embodiment of a sheet according to the present invention.
Figure 3:
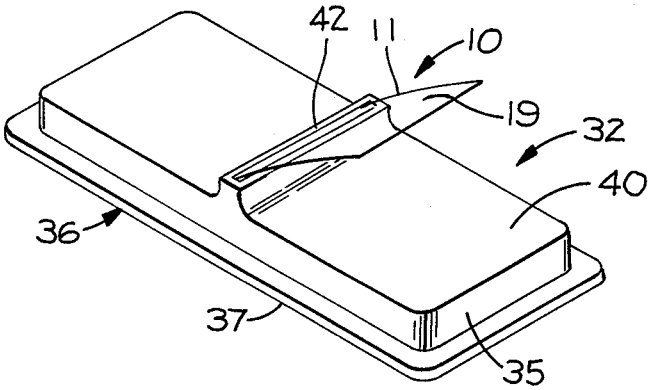
FIG. 3 is a perspective view of a first embodiment of dispenser container according to the present invention including a stack of sheets of the type shown in FIG. 1 adhered together in a stack.
Figure 4:
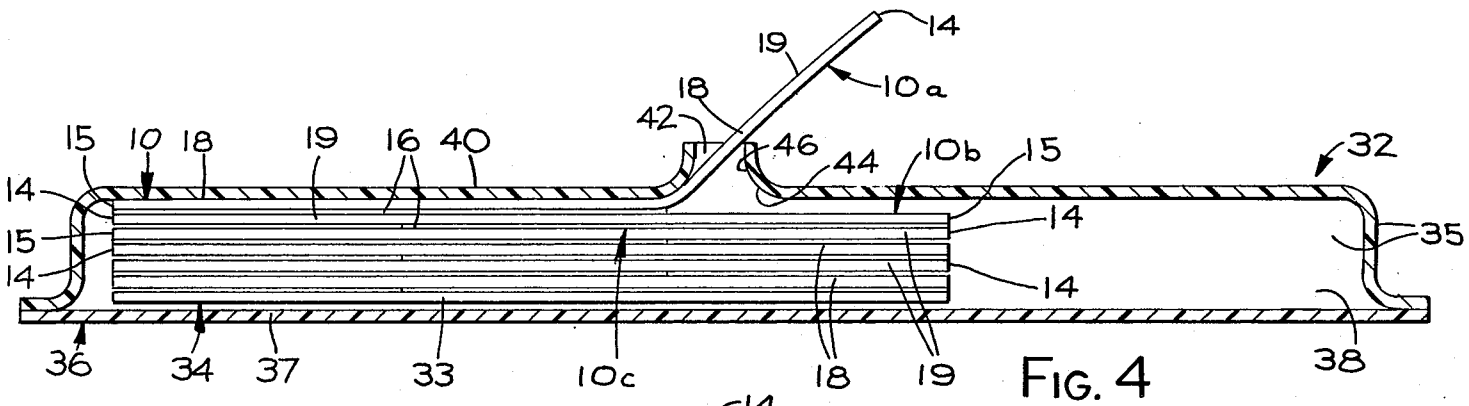
FIGS. 4 through 7 are enlarged sectional side views of the dispenser container of FIG. 3 in which the thickness of the sheets is greatly enlarged to show detail and which sequentially illustrate a sheet being pulled from the dispenser container.
Figure 5:
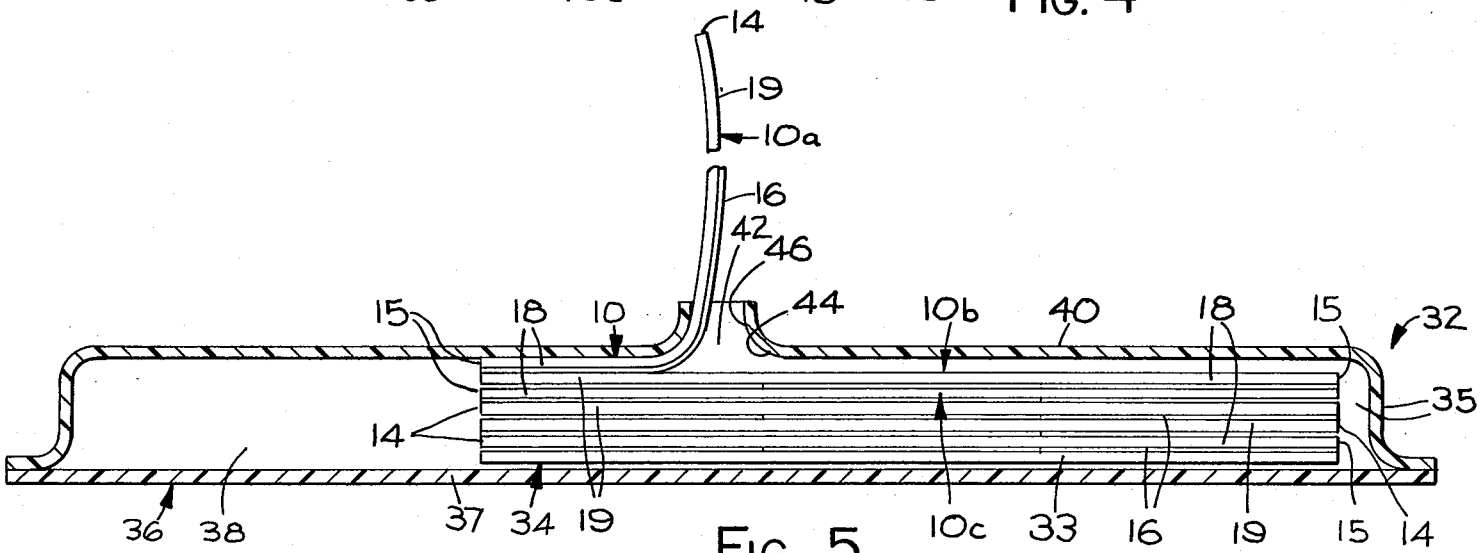
Figure 6:
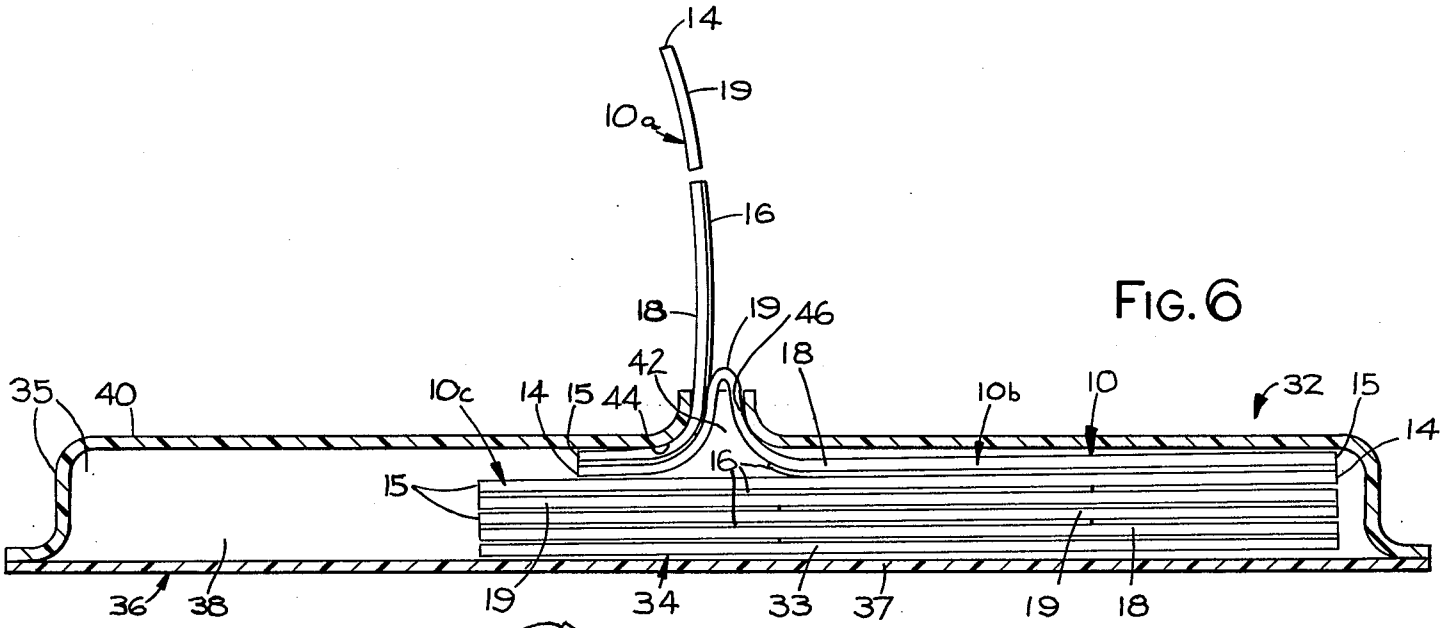
Figure 7:
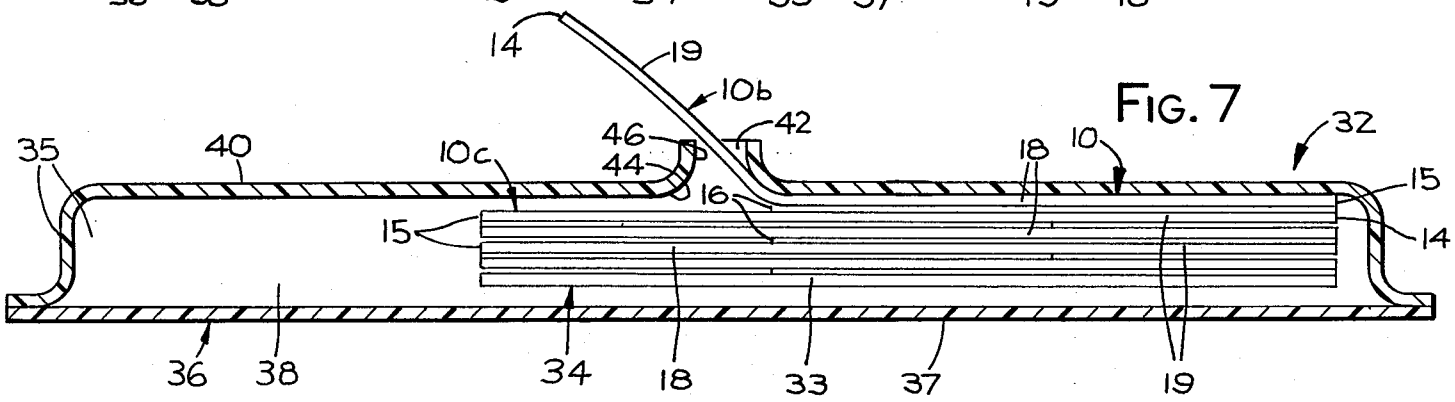

Referring now to FIG. 2 of the drawing, there is shown a second embodiment of a sheet according to the present invention generally designated by the reference numeral 20. The sheet 20 comprises an elongate rectangular layer 21 of transparent flexible polymeric material (e.g., 0.0056 centimeter thick cellulose acetate) having opposite major side surfaces and first and second opposite ends 24 and 25, and having a coating 26 of repositionable pressure sensitive adhesive on one of the side surfaces. The coating 26 of adhesive is exposed on a second end portion 28 of the side surface adjacent the second end 25, however the sheet 20 is free of adhesive on both of the side surfaces along a first tab end portion 29 thereof adjacent the first end 24 (which tab end portion 29 is smaller in area that the second end portion 28) because of a second layer 30 of polymeric material (e.g., 0.0038 centimeter thick cellulose acetate) adhered to the adhesive coated first layer 21 along the tab end portion 29. The second layer 30 is printed or died to make it brightly colored (e.g., red, green or yellow) so that the tab end portion 29 is visually distinctive, while the adhesive coated second end portion 28 is generally transparent when adhered to a substrate so that it will not obscure a substrate to which it is attached.

As is seen in FIGS. 3 through 7, a plurality of the flexible sheets 10 are preferably included in a dispenser package 32 according to the present invention in which the sheets 10 are releasably adhered to each other by the coatings 16 of pressure sensitive adhesive and with the bottom sheet 10 adhered to a bottom sheet 33 to form a stack 34 with adjacent ends 14 and 15 of the sheets 10 aligned and with the first and second ends 14 and 15 of successive sheets in the stack 34 adjacent. The dispenser package 32 also includes a molded plastic enclosure 36 comprising walls defining a chamber 38 in which the stack 34 of sheets 10 is positioned, which walls include upstanding side walls 35, a bottom wall 37 that could be removable from the side walls 35 to afford replacing the stack 34, and a top wall 40. The top wall 40 includes a portion defining a generally central transverse slot 42 parallel to the ends 14 and 15 of the sheets 10 positioned adjacent an uppermost sheet 10 in the stack (which uppermost sheet is identified as **10*a* in FIGS. 4 through 6) with the first end portion 19 of the uppermost sheet 10*a* projecting through the slot 42. Means are provided for affording relative movement between the portion of the top wall 40 defining the slot 42 and the uppermost sheet 10*a* from initial (FIG. 4) to final (FIG. 5) relative positions by making the chamber 38 longer than the stack 34 so that the stack 34 can shuttle back and forth in the chamber 38 to afford, as the uppermost sheet 10 is manually pulled through the slot 42, alignment of the slot 42 with successive portions of the uppermost sheet 10*a* toward the second end 15 of the uppermost sheet 10*a* as the successive portions are peeled from an underlying sheet 10 in the stack 34 (identified as 10*b* in FIGS. 4 through 7) to which the uppermost sheet 10*a* is adhered. In the final position (FIG. 5) the slot 42 is along the second end portion 18 of the uppermost sheet 10*a* and the first end portion 19 of the underlying sheet 10*b*. The first end portion 19 of the underlying sheet 10*b* is not coated with adhesive to provide means for preventing adhesion of that first end portion 19 to the sheet 10 below the underlying sheet 10*b* (which sheet below the underlying sheet 10*b* is identified as 10*c* in FIGS. 4 through 7) and thereby afford transverse folding of the the underlying sheet 10*b* (FIG. 6) at about the juncture between the tab and second portions 19 and 18 thereof and movement of the first end portion 19 of the underlying sheet 10*b* through the slot 42 (FIG. 6) with the second end portion 18 of the uppermost sheet 10*a* to leave, after the uppermost sheet 10*a* is fully peeled from the underlying sheet 10*b*, the first end portion 19 of the underlying sheet 10*b* in a position projecting through the slot 42 in the top wall 40 (FIG. 7) and the underlying sheet 10*b* and the portion of the top wall 40 defining the slot 42** in the initial relative position with respect to each other.

The portion of the top wall 40 defining the slot 42 preferably comprises opposed parallel cylindrically convex guide surface portions 44 adjacent the stack 34 leading to opposed parallel planar guide surface portions 46 extending at a right angle to the major portion of the surface of the top wall 40 adjacent the stack 34. The guide surface portions 44 and 46 insure that the second end portions 18 of sheets 10 being pulled from the stack 34 will be peeled away (and thus curl induced in the sheets 10 will be restricted), even if the first end portions 19 of those sheets 20 are pulled in a direction generally parallel to the top wall 40 rather than at a right angle thereto, and the spacing between the surface portions 44 and 46 helps prevent a phenomenon in which more than one sheet 10 is pulled through the slot 42 by the sheet 10*a* being removed which will happen if contact occurs between folded tab and adhesive coated second end portions 19 and 18 of the underlying sheet 10*b* as the underlying sheet 10*b* is pulled from the dispenser package 32 by the uppermost sheet 10*a*, and which phenomenon is exacerbated when that uppermost sheet 10*a* is pulled in a direction generally parallel to the top wall 40 rather than at a right angle thereto. Planar guide surface portions 46 at least about 0.5 centimeter (0.2 inch) long in a direction normal to the top surface of the stack 34 and spaced about 0.15 to 0.2 centimeter (0.06 to 0.075 inch) apart and arcuate guide surface portions 44 with a 0.15 centimeter (0.06 inch) radius have been found to greatly restrict that phenomenon when sheets 10 of the materials described above are dispensed, and also present the end portion 19 of the sheet 10 projecting through the slot 42 at close to a right angle to the top wall 40. Also, the phenomenon described above has been found to be further minimized by applying a release agent such as silicone to the tab portion 19, for example, by including it in the ink printed thereon.

Figure 8:
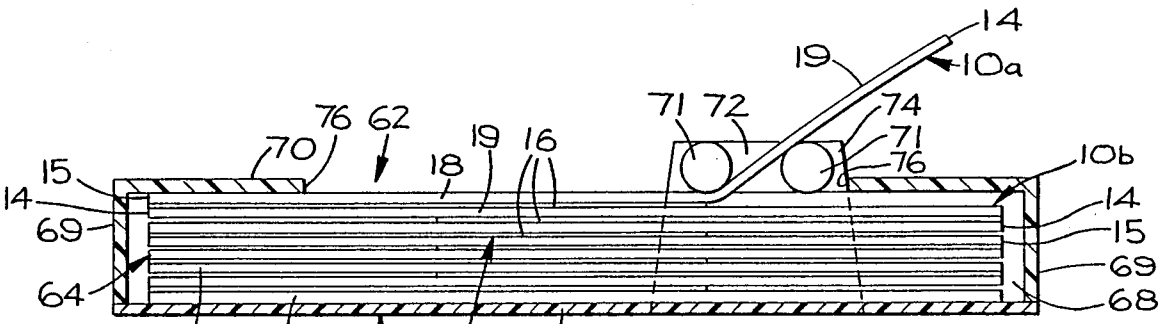
FIG. 8 is a sectional side view of a second embodiment of dispenser container according to the present invention including a stack of sheets of the type shown in FIG. 1 adhered together in a stack.

FIG. 8 illustrates a second embodiment of a dispenser package 62 according to the present invention in which a plurality of the sheets 10 are releasably adhered to each other by the coatings 16 of pressure sensitive adhesive and to a bottom sheet 65 to form a stack 64 identical to the stack 34. The dispenser package 62 also includes an enclosure 66 comprising walls defining a chamber 68 about the same size as the stack 64 in which the stack 64 of sheets 10 is positioned. The walls defining the enclosure 66 include a bottom wall 67, upstanding side walls 69, and a top wall 70. The top wall 70 in the dispenser package 62 is partially defined by a pair of cylindrical members 71 extending transversely across the top edges of the side walls 69. The members 71 are spaced apart to define a generally central transverse slot 72 between the members 71, which slot 72 is parallel to the ends 14 and 15 of the sheets 10 and is positioned adjacent an uppermost sheet 10*a* in the stack 64 with the first end portion 19 of the uppermost sheet 10*a* projecting through the slot 72. The ends of the cylindrical members are mounted on parallel plates 74 slidably mounted on the side walls 69 for reciprocal movement between limits defined by fixed portions 76 of the top wall 70 to provide means for affording relative movement between the portion of the top wall 70 defining the slot 72 and the uppermost sheet 10*a* from initial to final relative positions so that the portion of the top wall 70 defining the slot 72 can shuttle back and forth over the chamber 68 to afford, as the uppermost sheet 10*a* is manually pulled through the slot 72, alignment of the slot 72 with successive portions of the uppermost sheet 10*a* toward the second end 15 of the uppermost sheet 10*a* as the successive portions are peeled from an underlying sheet 10*b* in the stack 64. In the final position the slot 72 is along the second end portion 18 of the uppermost sheet 10*a* and the first end portion 19 of the underlying sheet 10*b* to afford folding and movement through the slot 72 of the first end portion 19 of the underlying sheet 10*b* with the second end portion 18 of the uppermost sheet 10*a* to leave the first end portion 19 of the underlying sheet 10*b* in a position projecting through the slot 72 in the top wall 70 and the underlying sheet 10*b* and portion of the top wall 70 defining the slot 72 in the initial relative position after the uppermost sheet 10*a* is fully peeled from the underlying sheet 10*b*. Thus, removal of the uppermost sheet 10*a* and positioning of the first end portion 19 of the underlying sheet 10*b* through the slot 72 in the dispenser package 62 occurs in essentially the same manner as removal of a sheet 10 from the dispenser package 32 except for movement of the portion of the top wall 70 defining the slot relative to the side and bottom walls 69 and 67 in the dispenser package 62 rather that movement of the stack 34 in the chamber 38 in the dispenser package 32.

Figure 9:
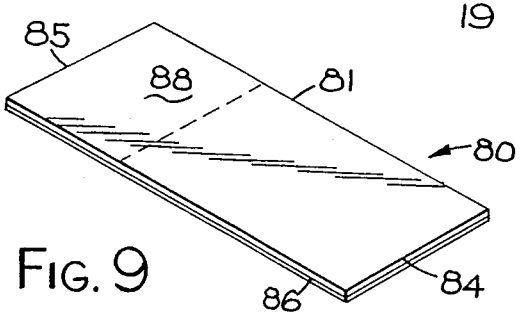
FIG. 9 is a perspective view of a third embodiment of a sheet.
Figure 10:
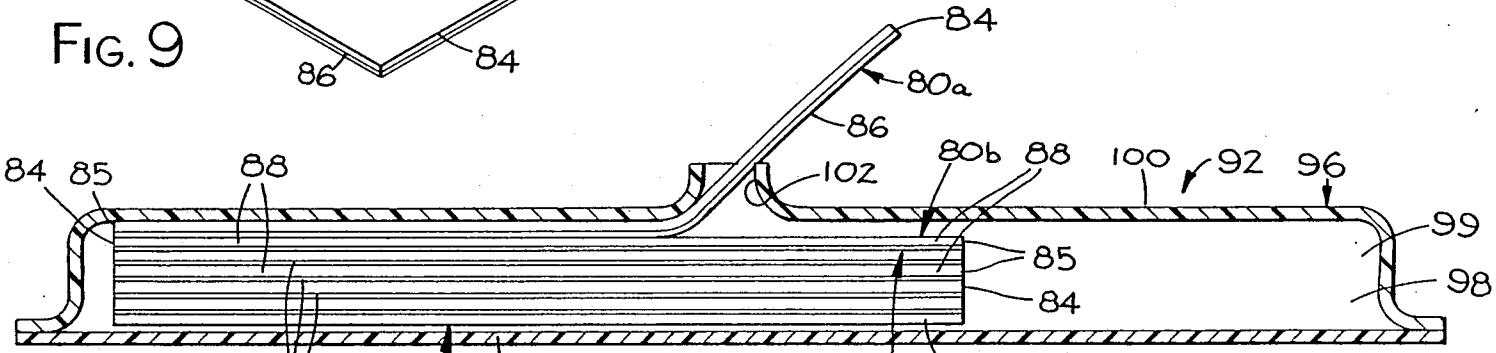
FIG. 10 is an enlarged sectional side view of a third embodiment of dispenser container according to the present invention including a stack of sheets of the type shown in FIG. 9 adhered together in a stack.

Referring now to FIG. 9 of the drawing, there is shown a third embodiment of a sheet 80 that can be used to form a stack 94 included in a dispenser package 92 according to the present invention illustrated in FIG. 10. The sheet 80 comprises a rectangular layer 81 of transparent flexible polymeric material having top and bottom major side surfaces and first and second opposite ends 84 and 85, having a coating 86 of pressure sensitive adhesive (which adhesive might be repositionable or more aggressive) on the bottom side surface, and having a coating of release material (e.g., silicone) on a part 88 of the top surface of the sheet 80 adjacent its second end 85. A plurality of the flexible sheets 80 are releasably adhered to each other and to a bottom sheet 90 by the coatings 86 of pressure sensitive adhesive to form the stack 94 with adjacent ends 84 and 85 of the sheets 80 aligned and with the first and second ends 84 and 85 of successive sheets in the stack 94 adjacent. The dispenser package 92 also includes an enclosure 96 (essentially identical to the enclosure 36) comprising walls defining a chamber 98 in which the stack 94 of sheets 80 is positioned, which walls include upstanding side walls 99, a bottom wall 97, and a top wall 100. The top wall 100 defines a generally central transverse slot 102 parallel to the ends 84 and 85 of the sheets 80 positioned adjacent an uppermost sheet 80 in the stack (identified as 80*a*) with the first end portion 88 of the uppermost sheet 80*a* projecting through the slot 102. Means are provided for affording relative movement between the top wall 100 and the uppermost sheet 80*a* from an initial relative position illustrated in FIG. 10 to a final relative position (which is not shown, but is essentially the same as the final relative position of the stack 34 and top wall 40 in the dispenser package 32 illustrated in FIG. 5) by making the chamber 98 longer than the stack 94 so that the stack 94 can shuttle back and forth in the chamber 98 to afford, as the uppermost sheet 80 is manually pulled through the slot 102, alignment of the slot 102 with successive portions of the uppermost sheet 80*a* toward the second end 85 of the uppermost sheet 10*a* as the successive portions are peeled from an underlying sheet 80 in the stack 94 (identified as 80*b*) to which the uppermost sheet 80*a* is adhered. In the final position the slot 102 is along the second end portion 88 of the uppermost sheet 80*a* and the first end portion 89 of the underlying sheet 80*b*, which first end portion 89 of the underlying sheet 80*b* is adjacent the coating of release agent on the part 88 of the sheet 80 beneath it (identified as 80*c*), which part 88 coated with release agent provides means for preventing adhesion of that first end portion 89 to the part 88 of the sheet 80*c* below the underlying sheet 80*b* and thereby affords transverse folding of the underlying sheet 80*b* and movement of the first end portion 89 of the underlying sheet 80*b* through the slot 102 with the second end portion 88 of the uppermost sheet 80*a* to leave, after the uppermost sheet 80*a* is fully peeled from the underlying sheet 80*b*, the first end portion 89 of the underlying sheet 80*b* in a position projecting through the slot 102 in the top wall 100 and the underlying sheet 80*b* and the top wall 100 in the initial relative position with respect to each other.

The present invention has now been described with reference to several embodiments thereof. It will be apparent to those skilled in the art that many changes or additions can be made in the embodiments described without departing from the scope of the present invention. For example, any of the sheets 10, 20, or 80 included in the dispenser packages 32, 62 or 92 may or may not have visually distinctive portions, or may be totally opaque, or may be totally transparent. Also, dispenser packages 32, 62 or 92 may have edges that interlock so that a plurality of dispenser packages including stacks of sheets with different visually distinctive characteristics (e.g., colors) may be locked together. Also such dispenser packages may have clips adapted to attach them to other dispensers. Thus the scope of the present invention should not be limited to the structures described in this application, but only by structures described by the language of the claims and the equivalents of those structures.

We claim:

1. A dispenser package comprising:

a plurality of flexible sheets, each of said sheets comprising a layer of material having opposite top and bottom major side surfaces and first and second opposite ends, having a coating of pressure sensitive adhesive on at least a second major end portion of said bottom side surface adjacent said second end, said sheets being releasably adhered to each other by adhesion of said coatings of pressure sensitive adhesive to portions of the top surfaces of underlying sheets adjacent the first ends of the underlying sheets to form a stack with adjacent ends of said sheets aligned and with the first and second ends of successive sheets in said stack being adjacent, and having means for preventing adhesion of minor first end portions of said sheets adjacent said first ends to underlying sheets in said stack;

an enclosure comprising walls defining a chamber in which said stack of sheets is positioned, said walls including a top wall including a portion defining a generally central transverse slot parallel to said ends of said sheets positioned adjacent an uppermost sheet in said stack with the first end portion of said uppermost sheet projecting through said slot; and means for affording relative movement between the portion of said top wall defining said slot and said uppermost sheet from initial to final relative positions to afford as said uppermost sheet is pulled through said slot alignment of said slot with successive portions of said uppermost sheet toward the second end of said uppermost sheet as said successive portions are peeled from an underlying sheet in said stack to which said uppermost sheet is adhered, in said final position said slot being along the second end portion of said uppermost sheet and the first end portion of said underlying sheet to afford folding of said underlying sheet and movement through the slot of the first end portion of said underlying sheet with the second end portion of said uppermost sheet to leave, after said uppermost sheet is fully peeled from said underlying sheet, the first end portion of said underlying sheet in a position projecting through said slot and said top wall and said underlying sheet in said initial position relative to each other.

2. A package according to claim 1 wherein said pressure sensitive adhesive is repositionable, and said first end portions of said sheets are brightly colored and are free of adhesive on said bottom surfaces to provide said means for preventing adhesion of minor first end portions of said sheets adjacent said first ends to an underlying sheet.

3. A package according to claim 1, wherein said sheets are each formed from only a single layer of polymeric material, said second end portions of said sheets are printed with a brightly colored ink, and said adhesive coated second end portions are generally transparent when adhered to a substrate.

4. A package according to claim 1 wherein said bottom surfaces of said sheets are entirely coated by said pressure sensitive adhesive, and said means for preventing adhesion of minor first end portions of said sheets adjacent said first ends to underlying sheets in said stack comprises coatings of release material on parts of the top surfaces of said underlying sheets adjacent said second ends.

5. A package according to claim 1 wherein said chamber defined by said walls affords shuttling end to end movement of said stack within said chamber to provide said means for affording relative movement between said top wall and said uppermost sheet from said initial to said final relative positions.

6. package according to claim 1 wherein said said top wall is movable on the rest of said walls defining said chamber to provide said means for affording relative movement between said top wall and said uppermost sheet from said initial to said final relative positions.

7. A package according to claim 1 wherein said top wall has opposed parallel cylindrically convex guide surface portions leading to opposed parallel linear guide surface portions extending at generally a right angle to the major portion of the top wall to define said slot, said opposed parallel linear guide surface portions having a length in a direction normal to the stack of greater than about 0.5 centimeter.

8. A dispenser package comprising:

a plurality of flexible sheets, each of said sheets comprising a layer of flexible polymeric material, having opposite major side surfaces and first and second opposite ends, and having a coating of pressure sensitive adhesive on a second end portion of one of said side surfaces adjacent said second end while being free of adhesive on both of said side surfaces along a first end portion thereof adjacent said first end, said sheets being releasably adhered to each other by said coatings of pressure sensitive adhesive to form a stack with adjacent ends of said sheets aligned and with the first and second ends of successive sheets in said stack being adjacent;

an enclosure comprising walls defining a chamber in which said stack of sheets is positioned, said walls including a top wall ihcluding a portior defining a generally central transverse slot positioned adjacent an uppermost sheet in said stack with the first end portion of said uppermost sheet projecting through said slot; and means for affording relative movement between the portion of said top wall defining said slot and said uppermost sheet from initial to final relative positions to afford, as said uppermost sheet is pulled through said slot, alignment of said slot with successive portions of said uppermost sheet toward the second end of said uppermost sheet as said successive portions are peeled from an underlying sheet in said stack to which said uppermost sheet is adhered, in said final position said slot being along the second end portion of said uppermost sheet and the first end portion of said underlying sheet to afford folding and movement through the slot of the first end portion of said underlying sheet with the second end portion of said uppermost sheet to leave, after said uppermost sheet is fully peeled from said underlying sheet, the first end portion of said underlying sheet in a position projecting through said slot and said top wall and said underlying sheet in said initial position relative to each other.

9. A package according to claim 8 wherein said pressure sensitive adhesive is repositionable, and said first end portions of said sheets are smaller in area than said second end portions and are brightly colored.

10. A package according to claim 8 wherein said sheets are each formed from only a single sheet of polymeric material, said second end portions of said sheets are printed with a brightly colored ink, and said adhesive coated second end portions are generally transparent when adhered to a substrate.

11. A package according to claim 8 wherein said chamber defined by said walls affords shuttling end to end movement of said stack within said chamber to provide said means for affording relative movement between said top wall and said uppermost sheet from said initial to said final relative positions.

12. A package according to claim 8 wherein said top wall has opposed parallel cylindrically convex guide surface portions leading to opposed parallel linear guide surface portions extending at generally a right angle to the major portion of the top wall to define said slot, said opposed parallel linear guide surface portions having a length in a direction normal to the stack of greater than about 0.5 centimeter.

* * * * *